US005686951A

United States Patent [19]

Koike et al.

[11] Patent Number: 5,686,951

[45] Date of Patent: Nov. 11, 1997

[54] INK JET PRINTING METHOD AND PRINTED ARTICLE

[75] Inventors: Shoji Koike, Yokohama; Masahiro Haruta, Tokyo; Tomoya Yamamoto, Kawasaki, all of Japan

[73] Assignee: Canon Kabushiki Kaisha, Tokyo, Japan

[21] Appl. No.: 548,073

[22] Filed: Oct. 25, 1995

Related U.S. Application Data

[63] Continuation of Ser. No. 99,930, Aug. 3, 1993, abandoned.

[30] Foreign Application Priority Data

Aug. 10, 1992 [JP] Japan ..... 4-212688
Jul. 28, 1993 [JP] Japan ..... 5-185910

[51] Int. Cl.[6] ..... B41J 2/01; B41J 3/407

[52] U.S. Cl. ..... 347/106; 347/100; 347/101

[58] Field of Search ..... 347/100, 101, 347/106, 105; 8/916, 917

[56] References Cited

U.S. PATENT DOCUMENTS 4,557,761 12/1985 Kobayashi et al. ..... 106/22
4,585,484 4/1986 Haruta et al. ..... 106/22
4,632,703 12/1986 Koike et al. ..... 106/22

(List continued on next page.)

FOREIGN PATENT DOCUMENTS 0550872 7/1993 European Pat. Off. .
0553760 8/1993 European Pat. Off. .
54-59936 5/1979 Japan .

OTHER PUBLICATIONS

Derwent Abstract (WPI) No. 87–338767 with respect to Japanese Patent Document No. 62–243890 (Oct. 24, 1987).

*Primary Examiner*—Valerie Lund
*Attorney, Agent, or Firm*—Fitzpatrick, Cella, Harper & Scinto

[57] ABSTRACT

Provided is an ink jet printing method for printing inks of at least two colors on a cloth by an ink jet system which comprises at least three steps of:

(a) the step of printing, on the cloth, the inks of at least two colors of a black ink and an another ink of at least one color selected from the group consisting of yellow, orange, red, magenta, blue and cyan so that the inks may at least partially overlap, (b) the step of thermally treating the cloth printed with the inks, and (c) the step of washing the thermally treated cloth, said cloth comprising a polyamide fiber, said black ink containing, as a dyestuff, at least one selected from the group consisting of C. I. Acid Black 24, 26, 52, 52:1, 109, 155, 172 and 222, C. I. Direct Black 19, 62 and 113, and a dyestuff represented by the formula (1)

(1)

wherein M is an alkaline metal, ammonium or an amine, or the formula (2)

(2)

wherein X is a hydrogen atom, a lower alkyl group or a phenyl group which may be substituted by an $SO_3M$ group; m is 0 or 1; M is an alkaline metal, ammonium or an amine; each of A, B and C is a benzene ring or a naphthalene ring which may have a substituent, but B and C are not simultaneously the naphthalene rings.

19 Claims, 3 Drawing Sheets

U.S. PATENT DOCUMENTS

| | | | |
|---|---|---|---|
| 4,655,834 | 4/1987 | Haruta et al. | 106/20 |
| 4,661,158 | 4/1987 | Kobayashi et al. | 106/22 |
| 4,677,445 | 6/1987 | Haruta | 346/1.1 |
| 4,689,078 | 8/1987 | Koike et al. | 106/22 |
| 4,702,742 | 10/1987 | Iwata et al. | 8/495 |
| 4,725,849 | 2/1988 | Koike et al. | 346/1.1 |
| 4,838,938 | 6/1989 | Tomida et al. | 106/22 |
| 4,849,770 | 7/1989 | Koike et al. | 346/1.1 |
| 4,853,036 | 8/1989 | Koike et al. | 106/20 |
| 4,923,515 | 5/1990 | Koike et al. | 106/20 |
| 4,957,553 | 9/1990 | Koike et al. | 106/20 |
| 4,965,612 | 10/1990 | Sakaki et al. | 346/1.1 |
| 4,969,951 | 11/1990 | Koike et al. | 106/22 |
| 5,017,227 | 5/1991 | Koike et al. | 106/22 |
| 5,043,740 | 8/1991 | Kneezel et al. | 347/12 |
| 5,053,078 | 10/1991 | Koike et al. | 106/22 |
| 5,059,246 | 10/1991 | Yamamoto et al. | 106/22 |
| 5,067,980 | 11/1991 | Koike et al. | 106/22 |
| 5,075,699 | 12/1991 | Koike et al. | 346/1.1 |
| 5,082,496 | 1/1992 | Yamamoto et al. | 106/22 |
| 5,099,255 | 3/1992 | Koike et al. | 346/1.1 |
| 5,101,217 | 3/1992 | Iwata et al. | 346/1.1 |
| 5,110,356 | 5/1992 | Shirota et al. | 106/22 |
| 5,118,351 | 6/1992 | Shirota et al. | 106/22 |
| 5,119,115 | 6/1992 | Buat et al. | 347/86 |
| 5,123,960 | 6/1992 | Shirota et al. | 106/22 |
| 5,124,718 | 6/1992 | Koike et al. | 346/1.1 |
| 5,127,946 | 7/1992 | Eida et al. | 106/22 |
| 5,130,723 | 7/1992 | Yamamoto et al. | 346/1.1 |
| 5,135,570 | 8/1992 | Eida et al. | 106/22 |
| 5,139,573 | 8/1992 | Yamamoto et al. | 106/22 |
| 5,141,558 | 8/1992 | Shirota et al. | 106/22 |
| 5,151,128 | 9/1992 | Fukushima et al. | 106/20 |
| 5,167,703 | 12/1992 | Eida et al. | 106/22 K |
| 5,178,671 | 1/1993 | Yamamoto et al. | 106/22 K |
| 5,190,581 | 3/1993 | Fukushima et al. | 106/20 D |
| 5,213,614 | 5/1993 | Eida et al. | 106/22 K |
| 5,215,577 | 6/1993 | Eida et al. | 106/22 K |
| 5,215,578 | 6/1993 | Eida et al. | 106/22 K |
| 5,216,437 | 6/1993 | Yamamoto et al. | 346/1.1 |
| 5,220,347 | 6/1993 | Fukushima et al. | 346/1.1 |
| 5,221,333 | 6/1993 | Shirota et al. | 106/20 D |
| 5,231,417 | 7/1993 | Shirota et al. | 346/1.1 |
| 5,248,991 | 9/1993 | Shirota et al. | 346/1.1 |
| 5,250,121 | 10/1993 | Yamamoto et al. | 106/22 R |
| 5,254,157 | 10/1993 | Koike et al. | 106/20 D |
| 5,258,066 | 11/1993 | Kobayashi et al. | 106/22 R |

INK JET PRINTING METHOD AND PRINTED ARTICLE

This application is a continuation, of application Ser. No. 08/099,930 filed Aug. 3, 1993, now abandoned.

BACKGROUND OF THE INVENTION

1. Field of the Invention

The present invention relates to a method for dyeing cloths by an ink let method, a printed article and an ink jet printing apparatus for use in the method.

2. Related Background Art

Nowadays, the main techniques of dyeing are screen textile printing and roller textile printing. However, these printing systems are not suitable for the production of many kinds of articles in small amounts, and the prompt application of these systems to fashion is also difficult. Thus, in recent years, it has been desired to develop an electronic textile printing system which does not require any plate making.

In answer to this demand, many dyeing methods using ink jet have been suggested, and they are largely expected in various fields.

Requirements of the ink jet dyeing are (1) that a sufficient density is given to a developed color, (2) that a color yield of a dye on a cloth is high, and after a washing step, the treatment of a waste solution is easy, (3) that irregular bleeding due to the mixing of different colors on the cloth is not remarkable, (4) that colors in wide range can be reproduced, and (5) that stable productivity is always possible.

In order to meet these requirements, conventionally, various kinds of additives have been mainly added to an ink, the shot-in quantity of the ink has been adjusted, or the cloth has been beforehand treated. These techniques are insufficient to meet all of the above-mentioned requirements.

For example, when the inks are mixed or adjacently dyed on the cloth, the density and the color tone of printed colors and the reproducibility of the colors printed under the same dyeing conditions depend largely upon the combination or the shot-in order of dyes to be used. In consequence, the above-mentioned requirements (1), (3), (4), (5) and the like cannot be often met. For the sake of expressing the various colors, the above-mentioned conventional techniques are still poor.

Particularly, in the ink jet dyeing, it is desired to express more kinds of colors than in a conventional ink jet print onto a recording material such as a paper. With regard to an image of a black color, a black ink has been mixed with other colors so as to express a desired finely different black color, and in this case, the above-mentioned problems have often occurred.

Furthermore, also in a boundary between a black image and another color image, the above-mentioned problems are remarkable, so that any sharp and bleeding-free image cannot be formed.

SUMMARY OF THE INVENTION

Thus, an object of the present invention is to provide an ink jet printing method by which the above-mentioned problems of the ink jet dyeing at the time of the ink jet dyeing can be solved, and especially in the case that an image is formed by printing a black color adjacently to another color or by mixing these colors, good color developing properties and the sharp and bleeding-free image can be obtained stably, even when the shot-in order of dyes and dyeing conditions are changed.

Another object of the present invention is to provide a printed article by the use of the above-mentioned ink jet printing method.

Still another object of the present invention is to provide an ink jet printing apparatus for use in the above-mentioned ink jet printing method.

These objects can be achieved by the following techniques of the prevent invention.

The first aspect of the present invention is directed to an ink jet printing method for printing inks of at least two colors on a cloth by an ink jet system which comprises at least three steps of:

(a) the step of printing, on the cloth, the inks of at least two colors of a black ink and an another ink of at least one color selected from the group consisting of yellow, orange, red, magenta, blue and cyan so that the inks may at least partially overlap, (b) the step of thermally treating the cloth printed with the inks, and (c) the step of washing the thermally treated cloth, said cloth comprising a polyamide fiber, said black ink containing, as a dyestuff, at least one selected from the group consisting of C. I. Acid Black 24, 26, 52, 52:1, 109, 155, 172 and 222, C. I. Direct Black 19, 62 and 113, and a dyestuff represented by the formula (1)

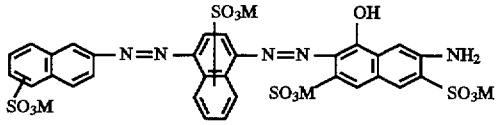

(1)

wherein M is an alkaline metal, ammonium or an amine, or the formula (2)

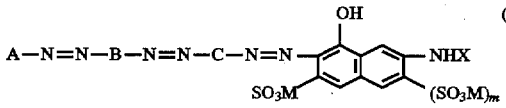

(2)

wherein X is a hydrogen atom, a lower alkyl group or a phenyl group which may be substituted by an $SO_3M$ group; m is 0 or 1; M is an alkaline metal, ammonium or an amine; each of A, B and C is a benzene ring or a naphthalene ring which may have a substituent, but B and C are not simultaneously the naphthalene rings.

The second aspect of the present invention is directed to an article printed by the above-mentioned ink jet printing method.

The third aspect of the present invention is directed to an ink set for use in the above-mentioned ink jet printing method, said ink set being characterized by including at least two color inks of a black ink and an another ink of at least one color selected from the group consisting of yellow, orange, red, magenta, blue and cyan.

The fourth aspect of the present invention is directed to a printed article in which a cloth is printed in a partial overlap state with at least two dyestuffs of a black dyestuff and at least one dyestuff selected from the group consisting of yellow, orange, red, magenta, blue and cyan, said black dyestuff containing at least one selected from the group consisting of C. I. Acid Black 24, 26, 52, 52:1, 109, 155, 172 and 222, C. I. Direct Black 19, 62 and 113, a dyestuff represented by the formula (1)

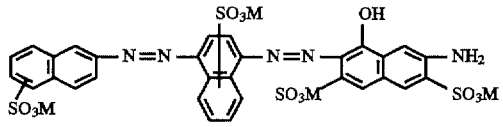

(1)

wherein M is an alkaline metal, ammonium or an amine, or the formula (2)

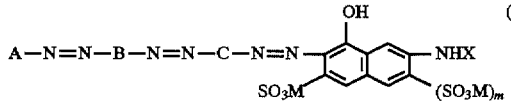

(2)

wherein X is a hydrogen atom, a lower alkyl group or a phenyl group which may be substituted by an $SO_3M$ group; m is 0 or 1; M is an alkaline metal, ammonium or an amine; each of A, B and C is a benzene ring or a naphthalene ring which may have a substituent, but B and C are not simultaneously the naphthalene rings, and said printed article being a cloth comprising a polyamide fiber.

The fifth aspect of the present invention is directed to a processed article obtained by further processing the above-mentioned printed article.

The sixth aspect of the present invention is directed to a recording unit for use in the above-mentioned ink jet printing method which is equipped with an ink containing portion containing the ink and a head portion for ejecting the ink in the form of ink droplets.

The seventh aspect of the present invention is directed to an ink cartridge for use in the above-mentioned ink jet printing method which is equipped with an ink containing portion containing the ink.

The eighth aspect of the present invention is directed to an ink jet printer for use in the above-mentioned ink jet printing method which is equipped with a recording unit having an ink containing portion containing the ink and a head for ejecting the ink in the form of ink droplets.

DETAILED DESCRIPTION OF THE PREFERRED EMBODIMENTS

Figure 1:
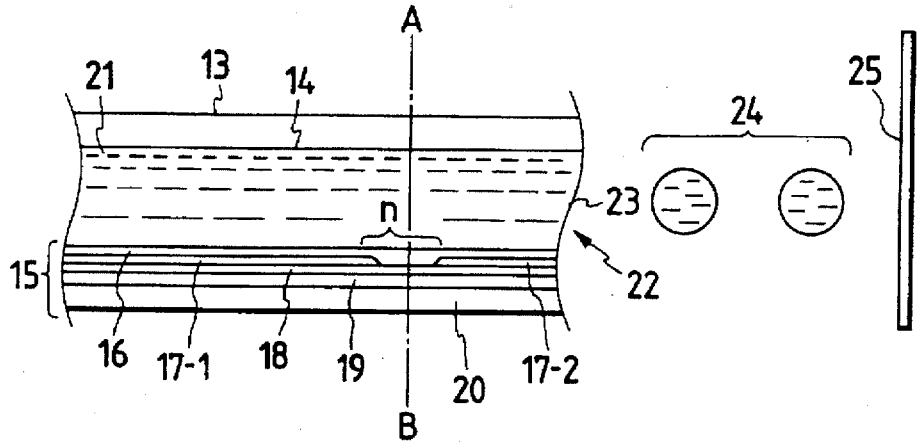
FIG. 1 is a longitudinal cross section of a head of an ink jet recording apparatus.

Now, the present invention will be described in detail.

A material constituting a cloth which can be used in the present invention include polyamide fibers. Above all, nylon, silk and wool are preferable. These fibers can be used in any form of fabric, knit and nonwoven fabric.

Needless to say, the cloth preferably comprises 100% of the polyamide fiber, but a mixed fabric, a mixed nonwoven fabric and the like of the polyamide fiber and another material such as rayon, cotton, acetate fiber, polyurethane fiber or acrylic fiber can also be used as the cloth for textile printing in the present invention, so long as a mixing ratio of the polyamide fiber is 30% or more, preferably 50% or more.

The physical properties of the polyamide fiber constituting the cloth and a thread comprising this fiber should be present in a certain range. For example, in the case of the nylon, the average thickness of the nylon fiber is preferably controlled to from 1 to 10 d (denier), more preferably from 2 to 6 d, and the average thickness of the nylon thread comprising the nylon fiber is preferably controlled to from 20 to 100 d, more preferably from 25 to 80 d, most preferably from 30 to 70 d.

In the case of the silk, as characteristics of the fiber itself, the average thickness of the silk fiber is preferably controlled to from 2.5 to 3.5 d, more preferably from 2.7 to 3.3 d, and the average thickness of the silk thread comprising the silk fiber is preferably controlled to from 14 to 147 d, more preferably from 14 to 105 d. The cloth of such a silk which is prepared by a known method can be preferably used.

The cloth which is used in the present invention can be subjected to a conventional pretreatment, if necessary. In particular, it is more preferable to pretreat the cloth with a solution containing from 0.01 to 20% by weight of urea, a water-soluble metallic salt or a water-soluble polymer.

Examples of the water-soluble polymer include starch of corn, wheat and the like, cellulosic substances such as carboxymethyl cellulose, methyl cellulose and hydroxyethyl cellulose, polysaccharides such as sodium alginate, gum arabic, locust bean gum, gum tragacanth, guar gum and tamarind seeds, proteins such as gelatin and casein, and known natural water-soluble polymers such as tannin and lignin. Examples of synthetic polymers include known polyvinyl alcohol compounds, polyethylene oxide compounds, acylic acid-based water-soluble polymers and maleic anhydride-based water-soluble polymers. Among these compounds, the polysaccharide polymers and the cellulosic polymers are preferable.

Examples of the water-soluble metallic salts include halides of alkaline metals and alkaline earth metals which can form typical ion crystals and which have a pH in the range of from 4 to 10. Typical examples of these halides of the alkaline metals include NaCl, $Na_2SO_4$, KCl and $CH_3COONa$, and typical examples of these halides of the alkaline earth metals include $CaCl_2$ and $MgCl_2$. Above all, the salts of Na, K and Ca are preferable.

Next, reference will be made to a dyestuff by which the present invention is characterized and which is contained in the ink of the present invention.

The dyestuffs which can be used in the ink of the present invention are classified into acid dyes and direct dyes, and they are extremely limited from the viewpoints of color tone, dyeing properties, ejection properties and the like.

The present inventors have found that in an ink jet dyeing technique for successively ejecting ink droplets on a cloth, the quality of a printed article depends largely upon fine differences of a combination of the dyes to be used, the shot-in order and dyeing conditions.

This phenomenon are particularly influential in forming an image by printing the black color adjacently to another color or by mixing these colors.

In view of the above-mentioned problems, the present inventors have intensively conducted investigations, and they have found that a stable and good printed article can be obtained without being affected by the fine differences of the shot-in order and the dyeing conditions.

Among these dyestuffs, a particular interrelation is required, and they are extremely similar to each other in dyeing properties, coloring properties, affinity to another dyes and fibers, and the like.

In consequence, the dyestuffs which can be used in the present invention are limited to the following substances:

As dyestuffs in a black ink, C. I. Acid Black 24, 52, 52:1, 172, C. I. Direct Black 113, a compound represented by the formulae (4) and (5)

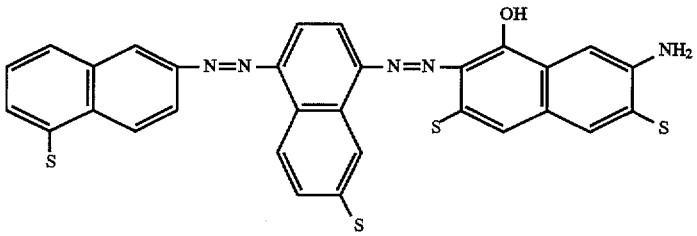

(4)

and

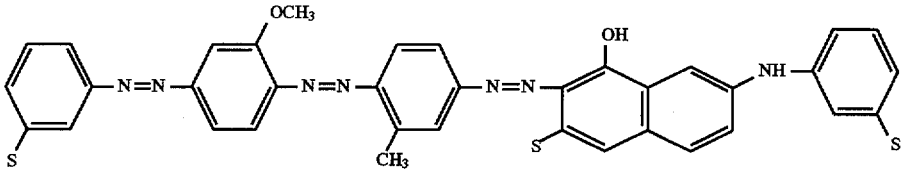

(5)

wherein S is an $SO_3Li$ group,

As dyestuffs in a yellow ink, C. I. Acid Yellow 19, 49, 79, 141, 169, C. I. Direct Yellow 58, 86, 132, As dyestuffs in an orange ink, C. I. Acid Orange 56, 95, 156, C. I. Direct Orange 34, As dyestuffs in a red ink, C. I. Acid Red 35, 114, 127, 145, 266, 318, 337, 361, C. I. Direct Red 89, 212, As dyestuffs in a magenta ink, C. I. Acid Red 143, 143:1, 249, 254, 265, 274, C. I. Acid Violet 47, 54, a compound represented by the formula (3)

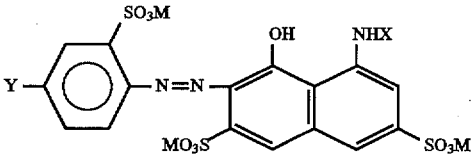

(3)

wherein Y is a hydrogen atom, a methyl group, a methoxy group, an acetylamino group or a nitro group, and it may form a naphthalene nucleus together with an adjacent benzene ring; X is an acetyl group, a benzoyl group, a paratoluenesulfonyl group or 4-chloro-6-hydroxy-1,3,5-triazine-2-yl group; and M is an alkaline metal, ammonium or an amine, and among them above, especially a compound represented by the formulae (6) and (7)

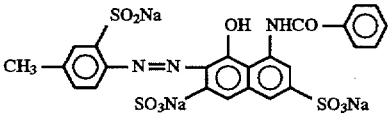

(6)

-continued and

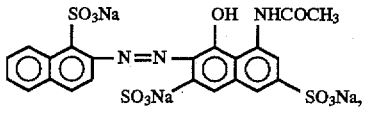

(7)

As dyestuffs in a cyan ink, C. I. Acid Blue 185, C. I. Direct Blue 86, 87, 189, 199, and As dyestuffs in a blue ink, C. I. Acid Blue 41, 62, 78, 80, 138, 140, 182, 205, 260, 277:1, 350.

At least one of these dyestuffs is contained in the ink. The total amount of the dyestuffs is usually in the range of from 1 to 20% by weight, preferably from 1.5 to 15% by weight, more preferably from 2 to 10% by weight based on the total weight of the ink.

The ink of the present invention contains at least the above-mentioned dyestuff and an aqueous medium.

The amount of water is usually in the range of from 10 to 93% by weight, preferably from 25 to 87% by weight, more preferably from 30 to 80% by weight.

In addition, as an aqueous medium, an organic solvent is preferably used together with water.

Examples of the organic solvent include ketones and ketoalcohols such as acetone and diacetone alcohol; ethers such as tetrahydrofuran and dioxane; oxyethylene or oxypropylene addition polymers such as diethylene glycol, triethylene glycol, tetraethylene glycol, dipropylene glycol, tripropylene glycol, polyethylene glycol and polypropylene glycol; alkylene glycols containing an alkylene group of 2 to 6 carbon atoms such as ethylene glycol, propylene glycol, trimethylene glycol, butylene glycol, and hexylene glycol; thiodiglycol; glycerin, 1,2,6-hexatriol; lower alkyl ethers of polyvalent alcohols such as ethylene glycol monomethyl (or monoethyl) ether, diethylene glycol monomethyl (or monoethyl) ether and triethylene glycol monomethyl (or monoethyl) ether; lower dialkyl ethers of polyvalent alcohols such as triethylene glycol dimethyl (or diethyl) ether and tetraethylene glycol dimethyl (or diethyl) ether; sulfolane, N-methyl-2-pyrrolidone, and 1,3-dimethyl-2-imidazolidinone.

The above-mentioned media may be used singly or in combination, but the most preferable aqueous medium composition is a solvent containing at least one polyvalent alcohol. Above all, aqueous media containing thiodiglycol or diethylene glycol alone as well as both diethylene glycol and thiodiglycol in combination are particularly suitable.

The amount of the water-soluble organic solvent is usually in the range of from 5 to 60% by weight, preferably from 5 to 50% by weight based on the total weight of the ink.

As other substances to be added, there are chlorine ion and/or sulfate ion. When the chlorine ion and/or the sulfate ion are added in an amount of about 10 to about 20,000 ppm with respect to the dyestuff contained in the ink, coloring properties such as leveling properties and a color yield can be further improved preferably.

Furthermore, it is preferable that at least one selected from the group consisting of silicon, iron, nickel and zinc is contained in the ink, in a total amount in the range of from 0.1 to 30 ppm, preferably from 0.2 to 20 ppm, more preferably 0.3 to 10 ppm.

In addition, it is preferred that the ink contains calcium and/or magnesium together with the above-mentioned metal, the total amount of calcium and/or magnesium being in the range of from 0.1 to 30 ppm, preferably from 0.2 to 20 ppm, more preferably from 0.3 to 10 ppm. The addition of calcium and/or magnesium further improves the color yield.

The main components of the ink which can be used in the present invention are as described above, but other known additives can also be added, if necessary. Examples of the additives include a known dispersant, surface active agent, viscosity modifier, surface tension modifier and fluorescent brightener.

Examples of these additives include viscosity modifiers such as polyvinyl alcohols, celluloses and water-soluble resins; cationic and nonionic surface active agents; surface tension modifiers such as diethanolamine and triethanolamine; a pH adjustor such as a buffer solution; and a fungicide.

In the ink jet printing method of the present invention, a plurality of ink droplets are successively printed on the above-mentioned cloth, so that color mixing portions of at least two colors are formed. In this case, the total amount of the adhered dyestuffs in the color mixing portions is in the range of from 0.025 to 1 mg/cm$^2$, preferably 0.04 to 0.7 mg/cm$^2$, more preferably 0.05 to 0.5 mg/cm$^2$. This value can be determined by measuring the amount of the ejected ink and the density of the dyestuff in the ink. If the amount of the adhered dyestuff is less than 0.025 mg/cm$^2$, it is difficult to develop the colors at the high density, and therefore the effects of the present invention are not definitely exerted. If it is more than 1 mg/cm$^2$, the noticeable improvement effects in density, color yield and the like cannot be recognized.

The ink jet system which can be used in the above-mentioned ink jet method of the present invention may be any of conventional and known ink jet recording systems, but for example, a system in which the ink is subjected to the function of thermal energy in accordance with a process described in Japanese Patent Application Laid-open No. 54-59936 to bring about a volume change and the ink is then ejected through a nozzle by the functional force of this condition change, i.e., a thermal let system is most effective. This reason can be considered to be that in the above-mentioned system, the election rate of the ink is mainly in the range of from 5 to 20 m/sec, and the scatter of the droplets at the time of the ejection is particularly suitable for the cloth containing a polyamide fiber. According to the present invention, even if recording is continuously carried out for a long period of time in accordance with the above-mentioned system, soils on its heater do not settle and disconnection does not occur, which permits the stable textile printing.

In addition, in carrying out the above-mentioned ink jet printing method regarding the present invention, as conditions for obtaining the particularly high effects, it is preferable that an ejection droplet is from 20 to 200 pl, an ink shot-in quantity is from 4 to 40 nl/mm$^2$, a driving frequency is 1.5 kHz or more, and a head temperature is from 35° to 60° C.

Furthermore, the thus formed ink for the textile printing of the present invention is applied onto the above-mentioned cloth, but this application state is only an adhesive state. Therefore, it is preferable to successively carry out a fixing process for fixing the dyestuff on the fiber and a dyestuff removal process for removing the unfixed dyestuff. As the fixing process and the unfixed dyestuff-removing process, conventional and known methods are acceptable. For example, these processes can be achieved in accordance with the conventional and known technique for washing after a treatment by a steaming method, an HT steaming method or a thermofixing method. Among them, in case of adopting the HT steaming method, the effect of the present invention can be exhibited most effectively.

Moreover, the thus obtained printed article is cut into a desired size, if necessary, and the cut pieces of the cloth will be subjected to steps of sewing, adhesion, fusing and the like so as to obtain final articles such as neckties and handkerchieves.

One example of apparatus suitable to carry out the textile printing by the use of the ink of the present invention is an apparatus in which heat energy corresponding to a recording signal is applied to the ink in a chamber of a recording head to eject ink droplets. Now, this kind of apparatus will be described.

Figure 2:
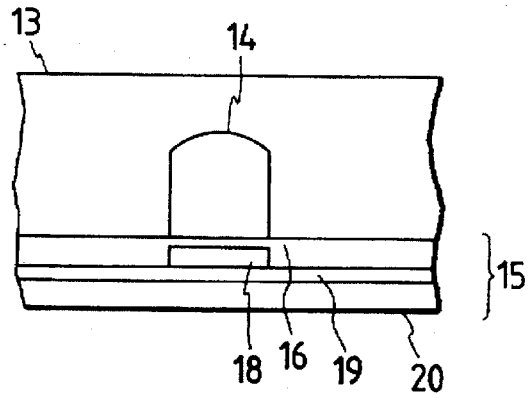
FIG. 2 is a cross section of the head portion of the ink jet recording apparatus.
Figure 3:
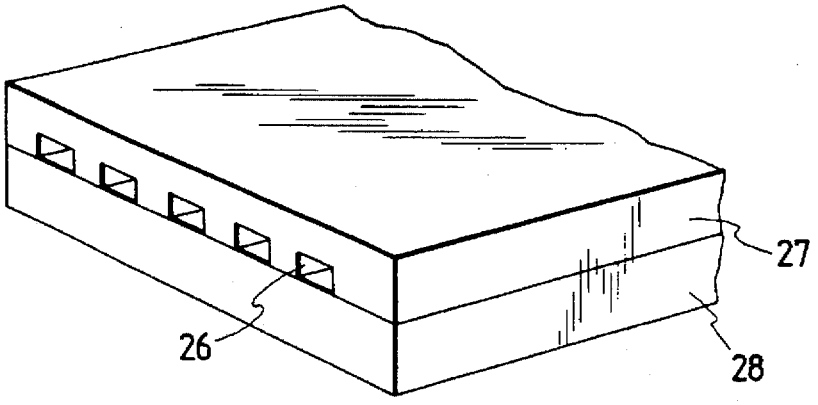
FIG. 3 is a perspective view illustrating the appearance of a head obtained by multiplying the head shown in FIG. 1.

A constitutional example of the head which is the main portion of the apparatus is shown in FIGS. 1, 2 and 3.

A head 13 is obtained by combining a glass, ceramic or plastic plate having a groove 14 for allowing an ink to pass therethrough with a heating head 15 (the head is shown in the drawings, but the present invention is not limited thereto). The heating head 15 is constituted of a protective film 16 formed from silicon oxide and the like, aluminum electrodes 17-1 and 17-2, a heating resistor layer 18 formed with Nichrome or the like, a heat accumulating layer 19 and a base plate 20 made of a material having a good heat releasing property such as alumina.

An ink 21 reaches an election orifice (fine pore) 22 and forms a meniscus 23 by pressure P.

Now, when an electrical signal is applied to the electrodes 17-1 and 17-2, heat is abruptly generated from a region indicated by of the heating head 15 to generate bubbles in the ink 21 which comes in contact with the heating head 15. Then, the meniscus 23 is protruded by the resultant pressure to eject the ink 21, so that recording droplets 24 fly from the orifice 22 toward a cloth 25 containing a polyamide fiber. FIG. 3 shows an appearance of a multi-head in which many heads one of which is shown in FIG. 1 are arranged. The multi-head is formed by closely combining a glass plate 27 having a multi-groove 26 with the same heating head 28 as in FIG. 1. In this connection, FIG. 1 a sectional view of the head 13 along an ink flow channel, and FIGS. 2 is a sectional view cut along a line A–B in FIG. 1.

Figure 4:
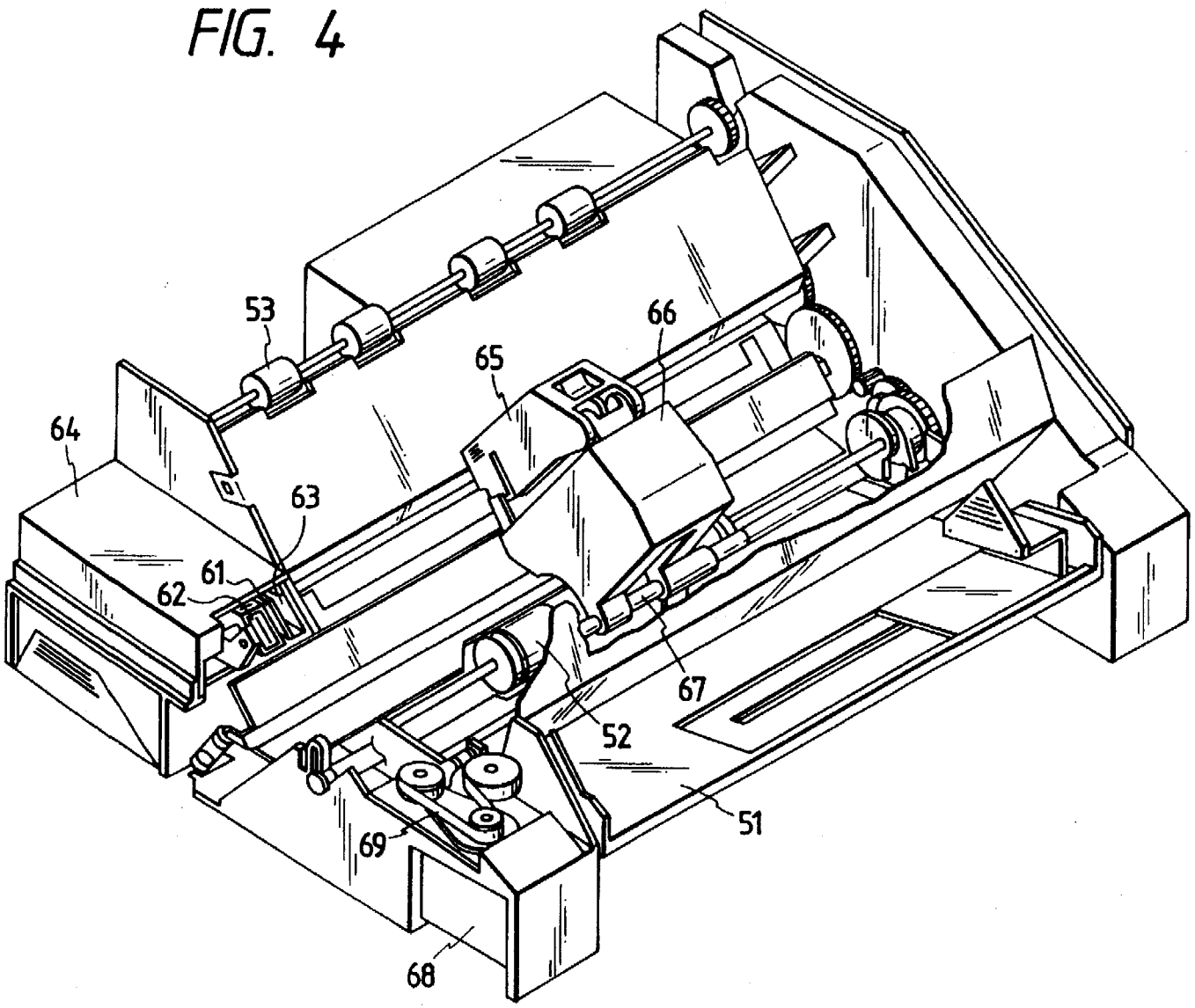
FIG. 4 is a perspective view illustrating one example of the ink jet recording apparatus.

FIG. 4 shows one example of an ink jet recording apparatus incorporated with the head.

In FIG. 4, reference numeral 61 is a blade as a wiping member, and its one end is a fixed end which is supported by a blade supporting member and which functions as a cantilever. The blade 61 is disposed adjacent to a recording region for the recording head. In this embodiment, the blade 61 is held so as to protrude into a moving passage of the recording head. Reference numeral 62 is a cap which is disposed at a home position adjacent to the blade 61 and which can move in the moving direction of the recording head and a vertical direction in order to come in contact with an ejection hole surface and cap the same. Furthermore, reference numeral 63 is an ink absorber arranged adjacent to the blade 61 and held so as to protrude into the moving passage of the recording head. An ejection recovery portion 64 is constituted of the blade 61, the cap 62 and the absorber 63, and water and dust on the ink ejection hole surface are removed therefrom by the blade 61 and the absorber 63.

Reference numeral 65 is a recording head which has an ejection energy generating means and ejects the ink to the cloth containing a polyamide fiber which is disposed so as to confront the ejection hole surface, thereby carrying out the recording. Reference numeral 66 is a carriage on which the recording head 65 is mounted and which can move the recording head 65. The carriage 66 is slidably engaged with a guide axis 67, and a part of the carriage 66 is connected (not shown) with a belt 69 which can be driven by a motor 68, whereby the carriage 66 can be moved along the guide axis 67 to the recording region for the recording head 65 and a region adjacent thereto.

Reference numeral 51 is a cloth feeder for feeding the cloth containing the polyamide fiber, and reference numeral 52 is a cloth feed roller which can be driven by a motor not shown in the figure. According to this constitution, the cloth containing the polyamide fiber is fed to a position which confronts the election hole surface of the recording head, and as the recording proceeds, the cloth is forwarded to a cloth discharge section where cloth discharge rollers 53 are arranged.

In the above-mentioned constitution, when the recording head 65 returns to the home position at the time of the end of the recording or the like, the cap 62 of the head recovery portion 64 retracts from the moving passage of the recording head 65, but the blade 61 protrudes into the moving passage. As a result, the ejection hole surface of the recording head 65 is wiped. In this connection, when the cap 62 comes in contact with the election hole surface of the recording head 65 to cap the ejection hole surface, the cap 62 moves so as to protrude into the moving passage of the recording head.

In the case that the recording head 65 moves from the home position to a recording start position, the cap 62 and the blade 61 are at the same position as in the above-mentioned wiping operation. As a result, even at the time of this movement of the recording head 65, the ejection hole surface of the recording head 65 can be wiped.

The movement of the recording head to the home position adjacent to the recording region is carried out at a predetermined interval at the end of the recording, at the time of ejection recovery and during the movement of the recording head in the recording region, and the above-mentioned wiping operation is made during this movement.

Figure 5:
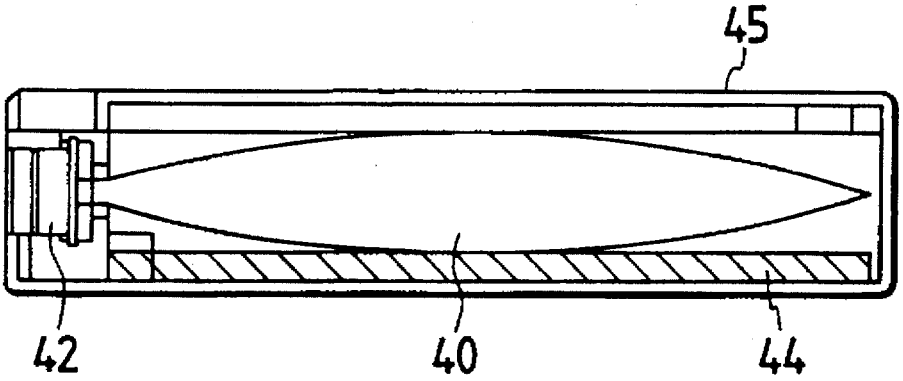
FIG. 5 is a longitudinal cross section of an ink cartridge.

FIG. 5 shows one example of an ink cartridge in which an ink fed to the head via an ink feed member such as a tube is contained. Here, reference numeral 40 is an ink containing section containing the ink to be fed, and for example, it is an ink bag. At the tip of the ink bag 40, a plug 42 made of a rubber is mounted. The ink in the ink bag 40 can be fed to the head by inserting a needle (not shown) into this plug 42. Reference numeral 44 is an ink absorber for absorbing and receiving a waste ink. In the present invention, the surface of the ink absorber which comes in contact with the ink is preferably made of polyolefin, particularly polyethylene. The ink jet recording apparatus for use in the present invention is not limited to the above-mentioned apparatus in which the head and the ink cartridge are separated. Therefore, an apparatus in which they are integrally associated as shown in FIG. 6 can also be used.

Figure 6:
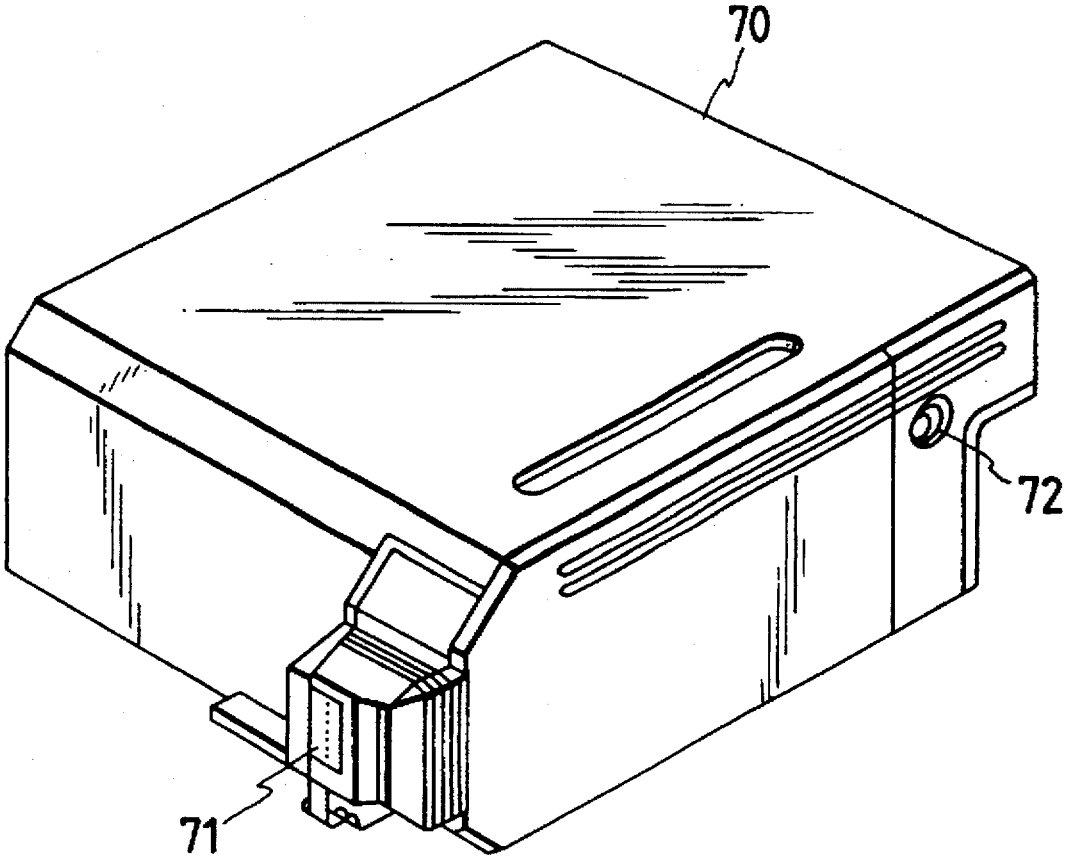
FIG. 6 is a perspective view of a recording unit.

In FIG. 6, reference numeral 70 is a recording unit, and in this recording unit, an ink containing section for containing the ink, for example, an ink absorber is placed. The ink absorber is constituted so that the ink in the ink absorber can be ejected in the form of ink droplets through the head portion 71 having a plurality of orifices. As the material of the ink absorber, it is preferable for the present invention to use polyurethane. Reference numeral 72 is an air passage for communicating the interior of the recording unit 70 to the atmosphere. This recording unit 70 can also be used in place of the recording head shown in FIG. 4 and it is detachably attached to the carriage 66.

EXAMPLE

Next, the present invention will be described more detail in reference to examples and comparative examples, but the scope of the present invention should not be limited to these examples. In this connection, it is to be noted that parts and percent are based on weight, unless otherwise specified.

Preparation of Ink

Ink A

| | |
|---|---|
| Acid dye (C. I. Acid Black 24) | 6 parts |
| Thiodiglycol | 22 parts |
| Diethylene glycol | 11 parts |
| Water | 61 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain a black ink A.

Ink B

| | |
|---|---|
| Direct dye (C. I. Direct Yellow 86) | 5 parts |
| Diethylene glycol | 30 parts |
| Water | 65 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain a yellow ink B.

Ink C

| | |
|---|---|
| Acid dye (C. I. Acid Orange 95) | 7 parts |
| Diethylene glycol | 29 parts |
| Water | 64 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain an orange ink C.

Ink D

| | |
|---|---|
| Acid dye (C. I. Acid Red 266) | 5 parts |
| Diethylene glycol | 31 parts |
| Water | 64 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain a red ink D.

Ink E

| | |
|---|---|
| Compound (6) | 5 parts |
| Diethylene glycol | 31 parts |
| Water | 64 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain a magenta ink E.

Ink F

| | |
|---|---|
| Acid dye (C. I. Acid Blue 78) | 6 parts |
| Diethylene glycol | 33 parts |
| Water | 61 parts |

All of the above-mentioned components were mixed, and the pH of the mixed solution was adjusted to 7.7 with sodium hydroxide, followed by stirring for 2 hours. Afterward, the solution was filtered through a fluoropore filter FP-100 (trade name, made by Sumitomo Electric Industries, Ltd.) to obtain a blue ink F.

Ink G

| | |
|---|---|
| Direct dye (C. I. Direct Blue 199) | 6 parts |
| Diethylene glycol | 33 parts |
| Water | 61 parts |

All of the above-mentioned components were mixed, and the pH of the mixed solution was adjusted to 7.7 with sodium hydroxide, followed by stirring for 2 hours. Afterward, the solution was filtered through a fluoropore filter FP-100 (trade name, made by Sumitomo Electric Industries, Ltd.) to obtain a cyan ink G.

Ink H

| | |
|---|---|
| Compound (4) | 3 parts |
| Compound (5) | 2 parts |
| Diethylene glycol | 33 parts |
| Water | 62 parts |

All of the above-mentioned components were mixed, and the pH of the mixed solution was adjusted to 7.7 with sodium hydroxide, followed by stirring for 2 hours. Afterward, the solution was filtered through a fluoropore filter FP-100 (trade name, made by Sumitomo Electric Industries, Ltd.) to obtain a black ink H.

Ink a

| | |
|---|---|
| Acid dye (C. I. Acid Black 194) | 6 parts |
| Thiodiglycol | 22 parts |
| Diethylene glycol | 11 parts |
| Water | 61 parts |

All of the above-mentioned components were mixed, and the pH of the mixed solution was adjusted to 7.7 with sodium hydroxide, followed by stirring for 2 hours. Afterward, the solution was filtered through a fluoropore filter FP-100 (trade name, made by Sumitomo Electric Industries, Ltd.) to obtain a black ink a.

Ink b

| | |
|---|---|
| Direct dye (C. I. Direct Black 154) | 5 parts |
| Diethylene glycol | 33 parts |
| Water | 62 parts |

All of the above-mentioned components were mixed, and the pH of the mixed solution was adjusted to 7.7 with sodium hydroxide, followed by stirring for 2 hours. Afterward, the solution was filtered through a fluoropore filter FP-100 (trade name, made by Sumitomo Electric Industries, Ltd.) to obtain a black ink b.

Ink c

| | |
|---|---|
| Direct dye (C. I. Direct Yellow 106) | 5 parts |
| Diethylene glycol | 30 parts |
| Water | 65 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain a yellow ink c.

Ink d

| | |
|---|---|
| Direct dye (C. I. Direct Orange 102) | 7 parts |
| Diethylene glycol | 29 parts |
| Water | 64 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain an orange ink d.

Ink e

| | |
|---|---|
| Acid dye (C. I. Acid Red 336) | 5 parts |
| Diethylene glycol | 31 parts |
| Water | 64 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain a red ink e.

Ink f

| | |
|---|---|
| Direct dye (C. I. Direct Red 9) | 5 parts |
| Diethylene glycol | 31 parts |
| Water | 64 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain a magenta ink f.

Ink g

| | |
|---|---|
| Direct dye (C. I. Direct Blue 160) | 6 parts |
| Diethylene glycol | 33 parts |
| Water | 61 parts |

All of the above-mentioned components were mixed, and the pH of the mixed solution was adjusted to 7.7 with sodium hydroxide, followed by stirring for 2 hours. Afterward, the solution was filtered through a fluoropore filter FP-100 (trade name, made by Sumitomo Electric Industries, Ltd.) to obtain a blue ink g.

Ink h

| | |
|---|---|
| Acid dye (C. I. Acid Blue 23) | 5 parts |
| Diethylene glycol | 31 parts |
| Water | 64 parts |

All of the above-mentioned components were mixed, and the pH of the mixed solution was adjusted to 7.5 with sodium hydroxide, followed by stirring for 2 hours. Afterward, the solution was filtered through a fluoropore filter FP-100 (trade name, made by Sumitomo Electric Industries, Ltd.) to obtain a cyan ink h.

Example 1

A fabric comprising 100% of nylon was first immersed in a 15% aqueous urea solution, squeezed to a pickup of 30%, and then dried so that a moisture content might be 10%.

Inks A, B, C and D were fed to a color bubble jet printer BJC820J (trade name, made by Canon Inc.) having an election rate of 12 m/sec, and two colors of all combinations of black and other colors were shot in a patch (2×4 cm) of the above-mentioned fabric in shot-in quantities of 2, 4, 6 and 8 nl/mm$^2$ so that an overlapped portion and a boundary portion might be observed, while the shot-in order of the inks was changed. In this case, same three patches were prepared in respective cases. Two of the three patches were superposed upon each other, and fixing was then carried out by subjecting them to a steaming treatment at 100° C. for 30 minutes. For the one remaining patch, the same treatment was done at 95° C. for 25 minutes. Afterward, they were washed using a neutral detergent. Next, evaluation was made by observing sharpness along the edge of a boundary, coloring properties of an overlapped portion at the time of the change of the shot-in order, and a difference of color development among the three printed patches. The results are shown in Table 1.

Example 2

A fabric comprising 85% of nylon and 15% of rayon was first immersed in a 30% aqueous urea solution, squeezed to a pickup of 30%, and then dried so that a moisture content might be 25%.

This fabric was printed by the same procedure as in Example 1, and then similarly evaluated. The results are shown in Table 1.

Example 3

A fabric comprising 100% of silk was first immersed in an aqueous solution containing 3% of polyvinyl alcohol and 5% of calcium chloride, squeezed to a pickup of 30%, and then dried so that a moisture content might be 21%.

This fabric was printed with inks E, F, G and H by the same procedure as in Example 1, and then similarly evaluated. The results are shown in Table 1.

Example 4

A fabric comprising 100% of wool was first immersed in a 10% aqueous sodium alginate solution, squeezed to a pickup of 30%, and then dried so that a moisture content might be 30%.

This fabric was printed by the same procedure as in Example 3, and then similarly evaluated. The results are shown in Table 1.

Example 5

A mixed fabric comprising 70% of nylon and 30% of polyurethane was first immersed in a 30% aqueous urea solution, squeezed to a pickup of 30%, and then dried so that a moisture content might be 25%.

This fabric was printed by the same procedure as in Example 3, and then similarly evaluated. The results are shown in Table 1.

Comparative Example 1

The same fabric comprising 100% of nylon as used in Example 1 was first immersed in a 15% aqueous urea solution, squeezed to a pickup of 30%, and then dried so that a moisture content might be 10%.

This fabric was printed with inks B, C, D and a by the same procedure as in Example 1, and then similarly evaluated. The results are shown in Table 1. As apparent from these results, sharpness along the edge of a printed portion and coloring properties at the time of the change of a shot-in order were poorer than in Example 1, and three printed patches were different in the coloring properties.

Comparative Example 2

The same fabric comprising 100% of silk as used in Example 3 was first immersed in an aqueous solution containing 3% of polyvinyl alcohol and 5% of calcium chloride, squeezed to a pickup of 30%, and then dried so that a moisture content might be 21%.

This fabric was printed with inks E, F, G and b by the same procedure as in Example 3, and then similarly evaluated. The results are shown in Table 1. As apparent from these results, sharpness along the edge of a printed portion and coloring properties at the time of the change of a shot-in order were poorer than in Example 3, and three printed patches were different in the coloring properties.

Comparative Example 3

The same fabric comprising 100% of nylon as used in Example 1 was first immersed in a 15% aqueous urea solution, squeezed to a pickup of 30%, and then dried so that a moisture content might be 10%.

This fabric was printed with inks B, D, and d by the same procedure as in Example 1, and then similarly evaluated. The results are shown in Table 1. As apparent from these results, sharpness along the edge of a printed portion and coloring properties at the time of the change of a shot-in order were poorer than in Example 1, and three printed patches were different in the coloring properties.

Comparative Example 4

The same fabric comprising 100% of nylon as used in Example 1 was first immersed in a 15% aqueous urea solution, squeezed to a pickup of 30%, and then dried so that a moisture content might be 10%.

This fabric was printed with inks a, c, d and e by the same procedure as in Example 1, and then similarly evaluated. The results are shown in Table 1. As apparent from these results, sharpness along an edge of a printed portion and coloring properties at the time of the change of a shot-in order were poorer than in Example 1, and three printed patches were different in the coloring properties.

Comparative Example 5

The same fabric comprising 100% of silk as used in Example 3 was first immersed in an aqueous solution containing 3% of polyvinyl alcohol and 5% of calcium chloride, squeezed to a pickup of 30%, and then dried so that a moisture content might be 21%.

This fabric was printed with inks b, f, g and h by the same procedure as in Example 3, and then similarly evaluated. The results are shown in Table 1. As apparent from these results, sharpness along the edge of a printed portion and coloring properties at the time of the change of a shot-in order were poorer than in Example 3, and three printed patches were different in the coloring properties.

TABLE 1

| | Sharpness of Edge*1 | Coloring properties of color mixing portion in case that shot-in order was changed*2 | Difference of k/s between two samples printed under the same conditions*3 | Difference of k/s between two samples printed under different conditions*4 |
|---|---|---|---|---|
| Example 2 | o | o | o | o |
| Example 3 | o | o | o | o |
| Example 4 | o | o | o | o |
| Example 5 | o | o | o | o |
| Example 6 | o | o | o | o |
| Comp. Ex. 1 | Δ | Δ | Δ | x |
| Comp. Ex. 2 | Δ | Δ | Δ | x |
| Comp. Ex. 3 | Δ | Δ | Δ | x |
| Comp. Ex. 4 | x | x | Δ | x |
| Comp. Ex. 5 | x | x | Δ | x |

*1: The sharpness along edge of the boundary was judged by visual observation. The evaluation was ranked as follows:
o: Good
Δ: Slightly poor
x: Poor
*2: The k/s values of the respective color mixing portions were measured, and the coloring properties were evaluated from a difference of the k/s values between the samples printed under the same conditions except that the shot-in orders were changed. The evaluation was ranked as follows: o: In the case that the maximum difference was less than 1. Δ: In the case that the maximum difference was in the range of from 1 to 2. x: In the case that the maximum difference was more than 2. $k/s = (1-R)^2/2R$ wherein R is a reflectance at a maximum absorption wavelength.

TABLE 1-continued

| | Sharpness of Edge*1 | Coloring properties of color mixing portion in case that shot-in order was changed*2 | Difference of k/s between two samples printed under the same conditions*3 | Difference of k/s between two samples printed under different conditions*4 |
|---|---|---|---|---|

*3: The coloring properties were evaluated from a difference of the k/s value between two samples printed under all the same conditions in accordance with the same ranking as in the above-mentioned *2.
*4: The evaluation was made on the basis of a difference of the k/s value between two samples printed under the same conditions except that dyeing conditions were changed, in accordance with the same ranking as in the above-mentioned *2.

What is claimed is:

1. An ink jet printing method for printing a cloth with inks of at least two colors by an ink jet system which comprises at least three steps of:

(a) printing the cloth with the inks of at least two colors of a black ink and an another ink of at least one color selected from the group consisting of yellow, orange, red, magenta, blue and cyan so that the inks at least partially overlap, (b) thermally treating the cloth printed with the inks, and (c) washing the thermally treated cloth, said cloth comprising a polyamide fiber, and said black ink containing at least one dyestuff selected from the group consisting of C.I. Acid Black 24, 52, 52:1 and 172, C.I. Direct Black 113, and a dyestuff of the formula

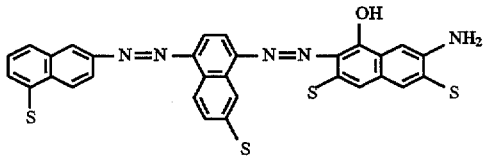

(4)

or of the formula

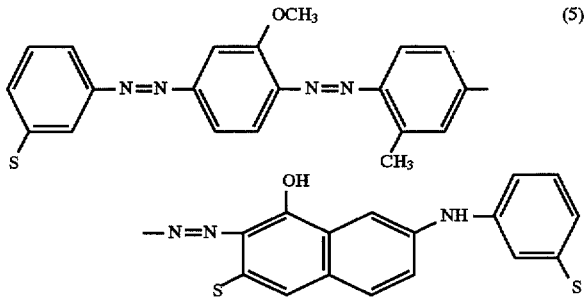

(5)

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

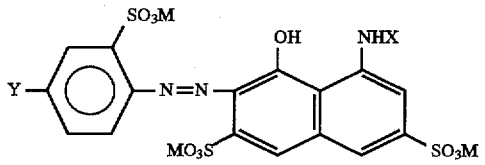

(3)

wherein Y is hydrogen, methyl, methoxy, acetylamino, nitro, or a naphthalene nucleus together with an adjacent benzene ring; X is acetyl, benzoyl, paratoluene-sulfonyl or 4-chloro-6-hydroxy-1,3,5-triazine-2-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I. Acid Blue 41, 62, 78, 80, 138, 140, 182, 205, 220, 221, 225, 260, 264, 277:1, 290, 324 and 350, C.I. Direct Blue 106, 192, 193, 229, 237, 290 and 291.

2. The ink jet printing method according to claim 1 wherein said ink jet system is an ink jet system in which thermal energy is utilized.

3. The ink jet printing method according to claim 1 wherein an ejection velocity of said ink is in the range of from 5 to 20 m/sec.

4. The ink jet printing method according to claim 1 wherein said thermal treatment step is a high-temperature steaming method (HT-steaming).

5. The ink jet printing method according to claim 1 wherein said cloth is subjected to a pretreatment prior to the step (a).

6. A printed article printed by an ink jet printing method for printing a cloth with inks of at least two colors by an ink jet system which comprises at least three steps of:

(a) printing the cloth with the inks of at least two colors of a black ink and an another ink of at least one color selected from the group consisting of yellow, orange, red, magenta, blue and cyan so that the inks at least partially overlap, (b) thermally treating the cloth printed with the inks, and (c) washing the thermally treated cloth, said cloth comprising a polyamide fiber, and said black ink containing at least one dyestuff selected from the group consisting of C.I. Acid Black 24, 52, 52:1, and 172, C.I. Direct Black 113, and a dyestuff of the formula

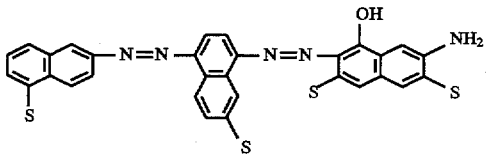

(4)

or of the formula

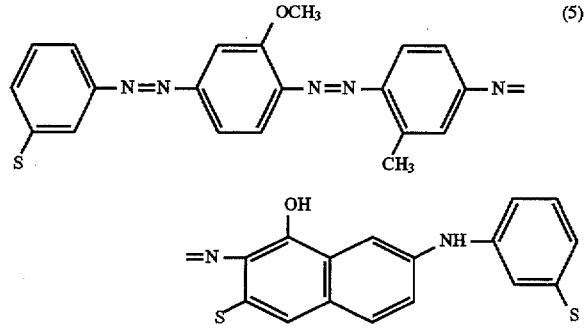

(5)

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

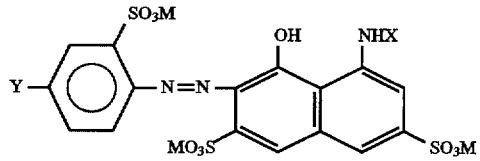

(3)

wherein Y is hydrogen, methyl, methoxy, acetylamino, nitro, or a naphthalene nucleus together with an adjacent benzene ring; X is acetyl, benzoyl, paratoluene-sulfonyl or 4-chloro-6-hydroxy-1,3,5-triazine-2-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I. Acid Blue 41, 62, 78, 80, 138, 140, 182, 205, 220, 221, 225, 260, 264, 277:1, 290, 324 and 350, C.I. Direct Blue 106, 192, 193, 229, 237, 290 and 291.

7. An ink set for use in an ink jet printing method for printing a cloth with inks of at least two colors by an ink jet system which comprises at least three steps of:

(a) printing the cloth with the inks of at least two colors of a black ink and an another ink of at least one color selected from the group consisting of yellow, orange, red, magenta, blue and cyan so that the inks at least partially overlap, (b) thermally treating the cloth printed with the inks, and (c) washing the thermally treated cloth, said cloth comprising a polyamide fiber, and said black ink containing at least one dyestuff selected from the group consisting of C.I. Acid Black 24, 52, 52:1, and 172, C.I. Direct Black 113, and a dyestuff of the formula

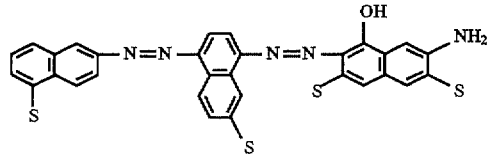

(4)

or of the formula

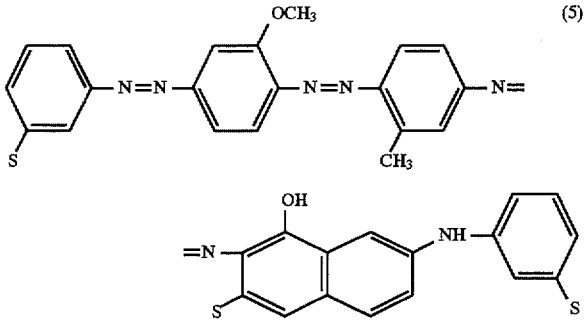

(5)

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

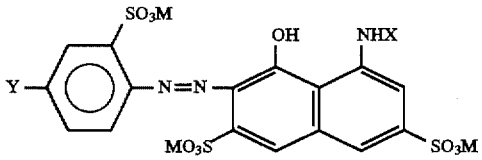

(3)

wherein Y is hydrogen, methyl, methoxy, acetylamino, nitro, or a naphthalene nucleus together with an adjacent benzene ring; X is acetyl, benzoyl, paratoluenesulfonyl or 4-chloro-6-hydroxy-1,3,5-triazine-2-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I Acid Blue 41, 62, 78, 80, 138, 140, 182, 205, 220, 221, 225, 260, 264, 277:1, 290, 324 and 350, C.I. Direct Blue 106, 192, 193, 229, 237, 290 and 291;

said ink set being characterized by including at least two color inks of said black ink and said another ink of at least one color selected from the group consisting of yellow, orange, red, magenta, blue and cyan.

8. A printed article in which a cloth is printed in a partial overlap state with at least two dyestuffs of a black dyestuff and at least one dyestuff selected from the group consisting of yellow, orange, red, magenta, blue and cyan, said black dyestuff containing at least one dyestuff selected from the group consisting of C.I. Acid Black 24, 52, 52:1 and 172, C. I. Direct Black 113, a dyestuff of the formula

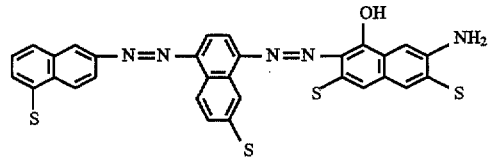

(4)

or of the formula

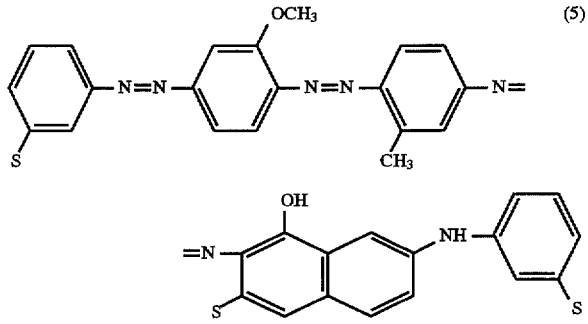

(5)

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

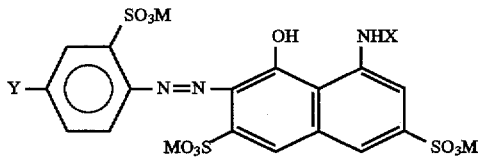

(3)

wherein Y is hydrogen, methyl, methoxy, acetylamino, nitro, or a naphthalene nucleus together with an adjacent benzene ring; X is acetyl, benzoyl, paratoluenesulfonyl or 4-chloro-6-hydroxy-1,3,5-triazine-2-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I. Acid Blue 41, 62, 78, 80, 128, 140, 182, 205, 220, 221, 225, 260, 264, 277:1, 290, 324 and 350, C.I. Direct Blue 106, 192, 193, 229, 237, 290 and 291, and said printed article being a cloth comprising a polyamide fiber.

9. A processed article obtained by further processing a printed article printed by an ink jet printing method for printing a cloth with inks of at least two colors by an ink jet system which comprises at least three steps of:

(a) printing the cloth with the inks of at least two colors of a black ink and an another ink of at least on color selected from the group consisting of yellow, orange, red, magenta, blue and cyan so that the inks at least partially overlap, (b) thermally treating the cloth printed with the inks, and (c) washing the thermally treated cloth, said cloth comprising a polyamide fiber, and said black ink containing at least one dyestuff selected from the group consisting of C.I. Acid Black 24, 52, 52:1, and 172, C.I. Direct Black 113 and dyestuff of the formula

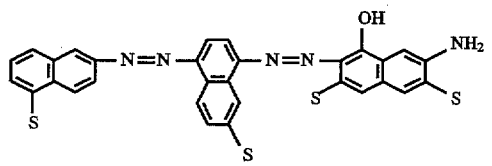

(4)

or of the formula

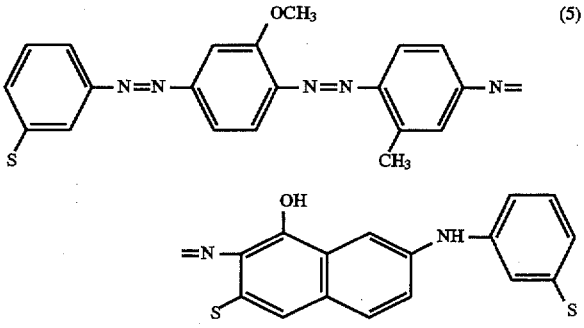

(5)

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

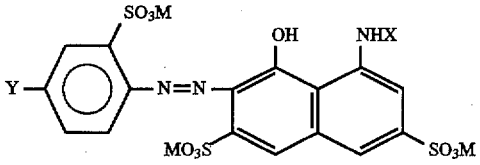

(3)

wherein Y is hydrogen, methyl, methoxy, acetylamino, nitro, or a naphthalene nucleus together with an adjacent benzene ring; X is acetyl, benzoyl, paratoluenesulfonyl or 4-chloro-6-hydroxy-1,3,5-triazine-2-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I. Acid Blue 41, 62, 78, 80, 138, 140, 182, 205, 220, 221, 225, 260, 264, 277:1, 290, 324 and 350, C.I. Direct Blue 106, 192, 193, 229, 237, 290 and 291.

10. The processed article according to claim 9 wherein said processed article is obtained by cutting the printed article into pieces having a predetermined size, and then subjecting the pieces to a step for obtaining a final processed article.

11. A recording unit for use in an ink jet printing method for printing a cloth with inks of at least two colors by an ink jet system which comprises at least three steps of:

(a) printing the cloth with the inks of at least two colors of a black ink and an another ink of at least one color selected from the group consisting of yellow, orange, red, magenta, blue and cyan so that the inks at least partially overlap, (b) thermally treating the cloth printed with the inks, and (c) washing the thermally treated cloth, said cloth comprising a polyamide fiber, and said black ink containing at least one dyestuff selected from the group consisting of C.I. Acid Black 24, 52, 52:1, and 172, C.I. Direct Black 113, and a dyestuff of the formula

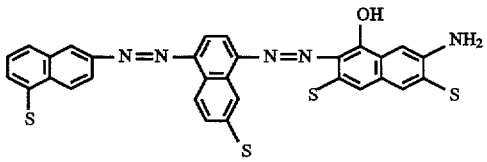

(4)

or of the formula

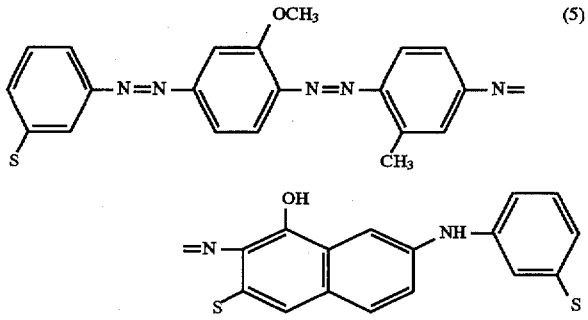

(5)

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

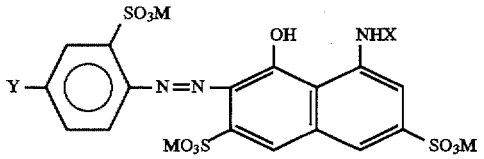

(3)

wherein Y is hydrogen, methyl, methoxy, acetylamino, nitro, or a naphthalene nucleus together with an adjacent benzene ring; X is acetyl, benzoyl, paratoluenesulfonyl or 4-chloro-6-hydroxy-1,3,5-triazine-2-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I. Acid Blue 41, 62, 78, 80, 138, 140, 182, 205, 220, 221, 225, 260, 264, 277:1, 290, 324 and 350, C.I. Direct Blue 106, 192, 193, 229, 237, 290 and 291;

which is equipped with an ink containing portion containing the ink and a head portion for ejecting the ink in the form of ink droplets.

12. The recording unit according to claim 11 wherein said head portion contains a head to eject ink droplets by applying thermal energy to the ink.

13. An ink cartridge for use in an ink jet printing method for printing a cloth with inks of at least two colors by an ink jet system which comprises at least three steps of:

(a) printing the cloth with the inks of at least two colors of a black ink and an another ink of at least one color selected from the group consisting of yellow, orange, red, magenta, blue and cyan so that the inks at least partially overlap, (b) thermally treating the cloth printed with the inks, and (c) washing the thermally treated cloth, said cloth comprising a polyamide fiber, and said black ink containing at least one dyestuff selected from the group consisting of C.I. Acid Black 24, 52, 52:1, and 172, C.I. Direct Black 113, and a dyestuff of the formula

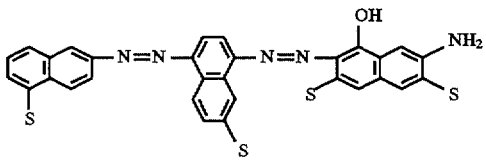

(4)

or of the formula

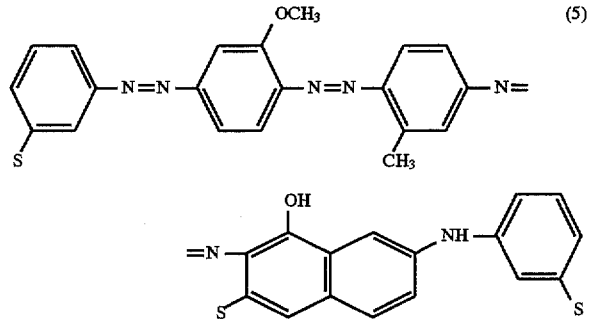

(5)

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

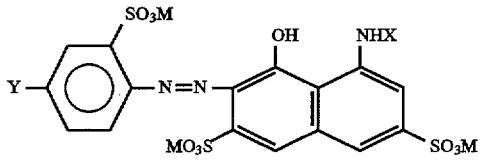

(3)

wherein Y is hydrogen, methyl, methoxy, acetylamino, nitro, or a naphthalene nucleus together with an adjacent benzene ring; X is acetyl, benzoyl, paratoluenesulfonyl or 4-chloro-6-hydroxy-1,3,5-triazine-2-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I. Acid Blue 41, 62, 78, 80, 138, 140, 182, 205, 220, 221, 225, 260, 264, 277:1, 290, 324 and 350, C.I. Direct Blue 106, 192, 193, 229, 237, 290 and 291;

which is equipped with an ink containing portion containing the ink.

14. An ink jet printer for use in an ink jet printing method for printing a cloth with inks of at least two colors by an ink jet system which comprises at least three steps of:

(a) printing the cloth with the inks of at least two colors of a black ink and an another ink of at least one color selected from the group consisting of yellow, orange, red, magenta, blue and cyan so that the inks at least partially overlap, (b) thermally treating the cloth printed with the inks, and (c) washing the thermally treated cloth, said cloth comprising a polyamide fiber, and said black ink containing at least one dyestuff selected from the group consisting of C.I. Acid Black 24, 52, 52:1, and 172, C.I. Direct Black 113, and a dyestuff of the formula

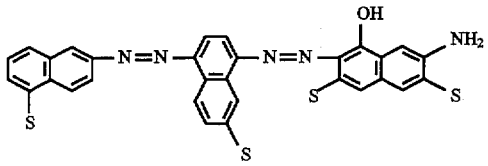

(4)

or of the formula

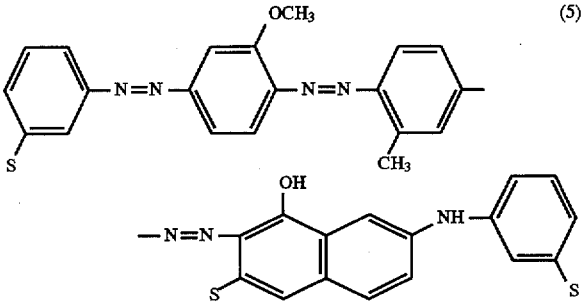

(5)

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

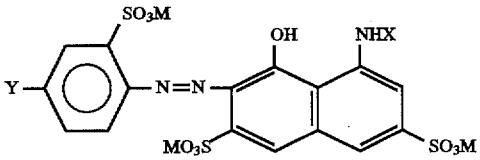

(3)

wherein Y is hydrogen, methyl, methoxy, acetylamino, nitro, or a naphthalene nucleus together with an adjacent benzene ring; X is acetyl, benzoyl, paratoluenesulfonyl or 4-chloro-6-hydroxy-1,3,5-triazine-2-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I. Acid Blue 41, 62, 78, 80, 138, 140, 182, 205, 220, 221, 225, 260, 264, 277:1, 290, 324 and 350, C.I. Direct Blue 106, 192, 193, 229, 237, 290 and 291;

which is equipped with a recording unit having an ink containing portion containing ink and a head portion for ejecting the ink in a form of ink droplets.

15. The ink jet printer according to claim 14 wherein said head portion contains a head to eject ink droplets by applying thermal energy to the ink.

16. An ink jet printer for use in an ink jet printing method for printing a cloth with inks of at least two colors by an ink jet system which comprises at least three steps of:

(a) printing the cloth with the inks of at least two colors of a black ink and an another ink of at least one color selected from the group consisting of yellow, orange, red magenta blue and cyan so that the inks at least partially overlap, (b) thermally treating the cloth printed with the inks, and (c) washing the thermally treated cloth said cloth comprising a polyamide fiber and, said black ink containing at least one dyestuff selected from the group consisting of C.I. Acid Black 24, 52 52:1, and 172, C.I. Direct Black 113, and a dyestuff of the formula

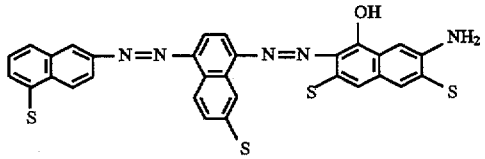

(4)

or of the formula

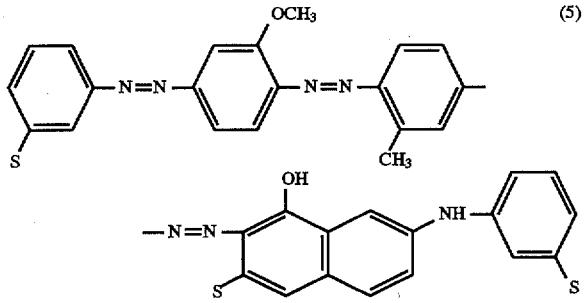

(5)

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

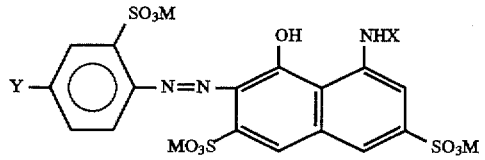

(3)

wherein Y is hydrogen, methyl, methoxy, acetylamino, nitro, or a naphthalene nucleus together with an adjacent benzene ring; X is acetyl, benzoyl, paratoluenesulfonyl or 4-chloro-6-hydroxy-1,3,5-triazine-2-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I. Acid Blue 41, 62, 78, 80, 138, 140, 182, 205, 220, 221, 225, 260, 264, 277:1, 290, 324 and 350, C.I. Direct Blue 106, 192, 193, 229, 237, 290 and 291;

which is equipped with a recording head for ejecting the ink, an ink cartridge with an ink containing portion containing the ink, and an ink feeding portion for feeding the ink from the ink cartridge to the recording head.

17. The ink jet printer according to claim 16 wherein said head is a head to eject in droplets by applying thermal energy to the ink.

18. A processed article obtained by further processing a printed article in which a cloth is printed in a partial overlap state with at least two dyestuffs of a black dyestuff and at least one dyestuff selected from the group consisting of yellow, orange, red, magenta, blue and cyan, said black dyestuff containing at least one dyestuff selected from the group consisting of C.I. Acid Black 24, 52, 52:1, and 172, C.I. Direct Black 113, and a dyestuff of the formula

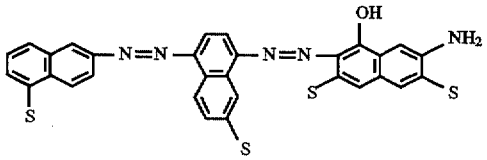

(4)

or of the formula

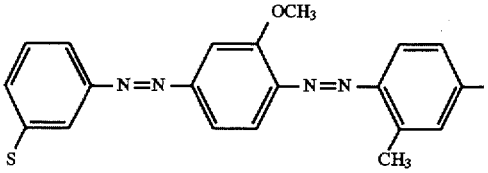

(5)

-continued

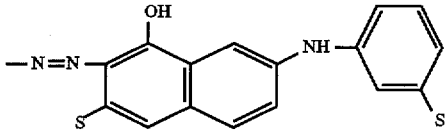

wherein S is $SO_3Li$ group, said yellow ink containing at least one dyestuff selected from the group consisting of C.I. Acid Yellow 19, 49, 79, 135, 141, 151, 169, 184, 230 and 242, C.I. Acid Orange 149, and C.I. Direct Yellow 28, 50, 58, 84, 86, 132, 137, 153 and 163, said orange ink containing at least one dyestuff selected from the group consisting of C.I. Acid Orange 3, 10, 56, 95, 116, 156 and 168, C.I. Direct Orange 27, 34, 46 and 107, and C.I. Acid Red 366, said red ink containing at least one dyestuff selected from the group consisting of C.I. Acid Red 35, 106, 114, 127, 145, 266, 318, 337, 341 and 361, and C.I. Direct Red 81, 89, 95 and 212, said magenta ink containing at least one dyestuff selected from the group consisting of C.I. Acid Red 143, 143:1, 249, 254, 265 and 274, C.I. Acid Violet 47, 54, 90 and 97, and a dyestuff represented by the formula (3)

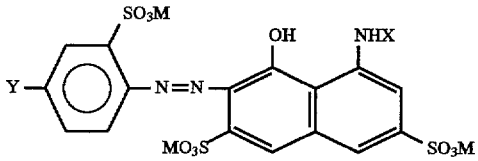

(3)

wherein Y is hydrogen, methyl, methoxy, acetylamino, nitro, or a naphthalene nucleus together with an adjacent benzene ring; X is acetyl, benzoyl, paratoluenesulfonyl or 4-chloro-6-hydroxy-1,3,5-triazine-2;-yl; and M is an alkaline metal, ammonium or an amine, said cyan ink containing at least one dyestuff selected from the group consisting of C.I. Acid Blue 185, and C.I. Direct Blue 86, 87, 189 and 199, and said blue ink containing at least one dyestuff selected from the group consisting of C.I Acid Blue 41, 62, 78, 80, 138, 140, 182, 205, 220, 221, 225, 260, 264, 277:1, 290, 324 and 350, C.I. Direct Blue 106, 192, 193, 229, 237, 290 and 291, and said printed article being a cloth comprising a polyamide fiber.

19. The processed article according to claim 18, wherein said processed article is obtained by cutting the printed article into pieces having a predetermined size, and then subjecting the pieces to a step for obtaining a final processed article.

* * * * *

UNITED STATES PATENT AND TRADEMARK OFFICE

CERTIFICATE OF CORRECTION

PATENT NO. : 5,686,951

DATED : November 11, 1997

INVENTOR(S) : SHOJI KOIKE, ET AL.

It is certified that error appears in the above-identified patent and that said Letters Patent is hereby corrected as shown below:

COLUMN 20

Line 35, "ink" should read --dyestuff--.
Line 40, "ink" should read --dyestuff--.
Line 44, "ink" should read --dyestuff--.
Line 48, "ink" should read --dyestuff--.
Line 65, "ink" should read --dyestuff--.

COLUMN 21

Line 1, "ink" should read --dyestuff--.

COLUMN 28

Line 10, "ink" should read --dyestuff--.
Line 15, "ink" should read --dyestuff--.
Line 19, "ink" should read --dyestuff--.
Line 23, "ink" should read --dyestuff--.
Line 40, "ink" should read --dyestuff--.
Line 43, "ink" should read --dyestuff--.
Line 44, "C.I Acid" should read --C.I. Acid--.

Signed and Sealed this

Seventeenth Day of March, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,686,951

DATED : November 11, 1997

INVENTOR(S) : SHOJI KOIKE, ET AL.

It is certified that error appears in the above-identified patent and that said Letters Patent is hereby corrected as shown below:

COLUMN 5:

Line 62,

" 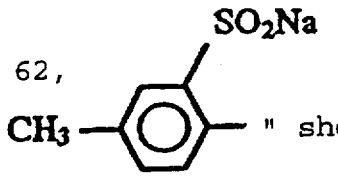 " should read

-- 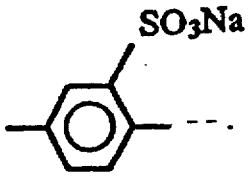 --.

COLUMN 7:

Line 57, "let" should read --jet--.
Line 59, "election" should read --ejection--.

COLUMN 8:

Line 45, "election" should read --ejection--.
Line 49, "by" should read --by n--.

COLUMN 9:

Line 30, "election" should read --ejection--.

UNITED STATES PATENT AND TRADEMARK OFFICE

CERTIFICATE OF CORRECTION

PATENT NO. : 5,686,951

DATED : November 11, 1997

INVENTOR(S) : SHOJI KOIKE, ET AL.

It is certified that error appears in the above-identified patent and that said Letters Patent is hereby corrected as shown below:

COLUMN 10:

Line 19, "EXAMPLE" should read --EXAMPLES--.

COLUMN 13:

Line 46, "election" should read --ejection--.

COLUMN 15:

Line 3, "and" should read --a and--.

COLUMN 19:

Line 62, "C.I" should read --C.I.--.

COLUMN 21:

Line 3, "128," should read --138,--.
Line 13, "on" should read --one--.
Line 23, "113" should read 113,--.

COLUMN 24:

Line 23, "CI." should read --C.I.--.

UNITED STATES PATENT AND TRADEMARK OFFICE

CERTIFICATE OF CORRECTION

PATENT NO. : 5,686,951 Page 3 of 3

DATED : November 11, 1997

INVENTOR(S) : SHOJI KOIKE, ET AL.

It is certified that error appears in the above-identified patent and that said Letters Patent is hereby corrected as shown below:

COLUMN 26:

Line 13, "red magenta" should read --red, magenta,--.
Line 16, "cloth" should read --cloth,--.
Line 17, "fiber" should read --fiber,--.
Line 19, "52" should read --52,--.

COLUMN 27:

Line 28, "in" should read --ink--.

COLUMN 28:

Line 38, "-2;-yl;" should read -- -2-yl;--.

Signed and Sealed this

First Day of September, 1998

Bruce Lehman

*Attest:*

BRUCE LEHMAN

*Attesting Officer*

*Commissioner of Patents and Trademarks*